United States Patent [19]

Sarver et al.

[11] Patent Number: 4,513,768

[45] Date of Patent: Apr. 30, 1985

[54] SOLAR ACTUATED DRAIN SYSTEM

[75] Inventors: Glen E. Sarver; Bernard W. Worstell, both of Marietta, Ohio

[73] Assignee: The B. F. Goodrich Company, Akron, Ohio

[21] Appl. No.: 528,191

[22] Filed: Aug. 31, 1983

[51] Int. Cl.[3] ..... F04F 10/00

[52] U.S. Cl. ..... 137/142; 137/140; 137/357

[58] Field of Search ..... 137/135, 140, 142, 147, 137/148, 150, 151, 357, 591

[56] References Cited

U.S. PATENT DOCUMENTS

| | | | |
|---|---|---|---|
| 3,199,307 | 8/1965 | Willis | 137/147 X |
| 4,059,126 | 11/1977 | Nickerson | 137/142 |
| 4,168,717 | 9/1979 | Rinker | 137/142 X |
| 4,171,709 | 10/1979 | Loftin | 137/142 X |
| 4,236,507 | 12/1980 | Vincent | 126/450 |
| 4,248,258 | 2/1981 | Devitt et al. | 137/147 X |
| 4,345,587 | 8/1982 | Carvalho | 126/450 |

*Primary Examiner*—Gerald A. Michalsky
*Attorney, Agent, or Firm*—James R. Lindsay

[57] ABSTRACT

A temperature actuated drain system is provided that comprises a siphon that has an inlet end for immersing in a pool of water to be drained from a roof surface and a discharge end communicating with a pressure-responsive one-way valve. A solar actuated enclosed chamber that contains a solar heat energy collector is located on the roof surface and is in open communication with the siphon by means of a tubular member that has its inlet end positioned closely adjacent the bottom of the interior of the chamber. The arrangement causes any appreciable amounts of water that accumulate within the chamber to be discharged from the chamber during the pumping action created by the heating and cooling of air within the chamber.

10 Claims, 4 Drawing Figures

FIG. 1
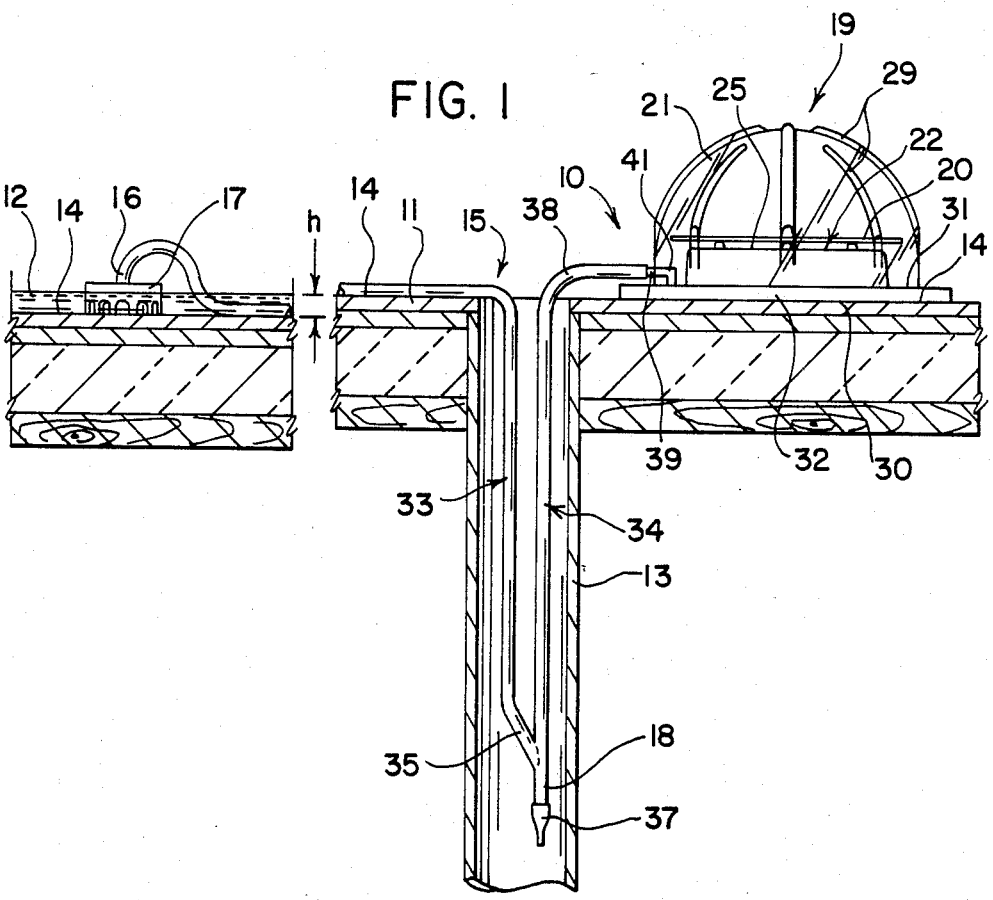
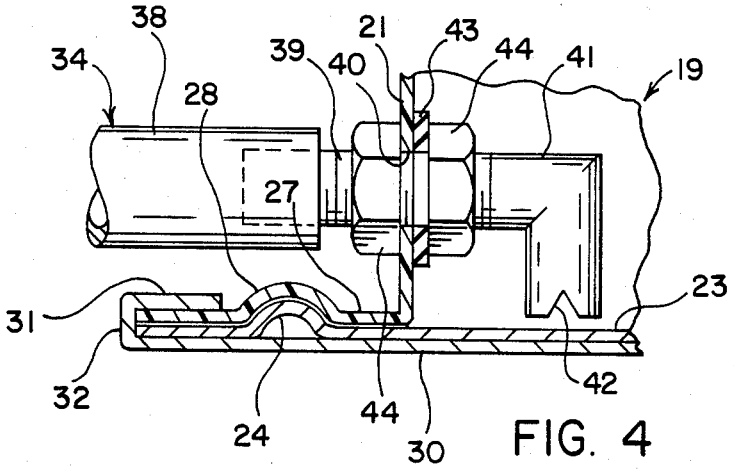
FIG. 4

SOLAR ACTUATED DRAIN SYSTEM

BACKGROUND OF THE INVENTION

This invention relates generally to drainage systems and more particularly to a temperature actuated drain system that can be used for draining pooled water from roofs.

A drain system of this general type is shown in U.S. Pat. No. 4,059,126, the disclosure thereof being incorporated herein by reference. The apparatus therein described utilizes a chamber which allows solar heat to penetrate into the chamber when the sun is shining and impinge upon a heat-absorbing plate within the chamber. The heated plate, in turn, causes the air within the chamber to be heated and, as a consequence, to expand. A pressure-responsive one-way valve allows expanding air to escape from the chamber until the pressure within the chamber equals that outside the chamber. When clouds shield the chamber from the sun or when the sun sets at night, the air within the chamber cools. A subatmospheric pressure is created within the chamber. Air is drawn through a tube and through a second pressure-responsive one-way valve into the chamber to return the pressure within the chamber to the ambient pressure outside of the chamber. The distal end of the tube is connected to a siphon having an inlet end immersed in a pool of water to be drained and an outlet end fitted with a third pressure-responsive one-way valve positioned at a level below the inlet end of the siphon. The solar actuated pumping action is continued until sufficient water is pulled into the siphon to cause the one-way valve at the discharge end of the siphon to open. Water will continue to be drawn into the siphon from the pool and expelled from the siphon until the pool is drained sufficiently that the inlet end of the siphon is no longer immersed in water.

An improved single valve drain system is shown in U.S. Pat. No. 4,168,717, the disclosure thereof being incorporated herein by reference. In the improved system, a chamber similar to the chamber of the above-described drain system is in continuous open communication with a siphon having an inlet end immersed in a pool of water to be drained and a discharge end fitted with a pressure-responsive one-way valve positioned at a level below the inlet end of the siphon. A pumping action of the type described above, except that expanding air is expelled through the one-way valve at the discharge end of the siphon, causes water to be pulled into the siphon until a sufficient weight of water is contained at the discharge end of the siphon tube to cause the one-way valve to open. Water will continue to be pulled from the pool, into the siphon and expelled from the siphon until the inlet end of the siphon is no longer immersed in water.

SUMMARY OF THE INVENTION

During the pumping action of the solar actuated chamber, small amounts of water at times are drawn into the chamber from the siphon system and accumulate as a pool of water in the bottom of the chamber. The water which is drawn into the chamber interfers with the efficient functioning of the drain system. The water accumulation will absorb heat that normally would be used for expanding air within the chamber when the sun is shining and solar energy is transmitted into the chamber. Conversely, the heated water will give up heat to the air within the chamber when the sun sets or is shielded by clouds and as a consequence interfers with the cooling of the air within the chamber. The present invention provides a solar actuated drain system that contains a vent tube communicating with the chamber which causes expulsion of objectionable water which may have collected in the bottom of the chamber, whereby the operating efficiency of the siphon drain is maintained automatically to an effective level.

DESCRIPTION OF THE DRAWINGS

The invention will be more fully understood from the following description of a specific embodiment of the invention and by referring to the accompanying drawings wherein:

FIG. 1 is a fragmentary secional view of an embodiment of the present invention installed on the roof of an industrial building;

FIG. 4 is an enlarged fragmentary view showing a portion of the solar actuated chamber shown in FIG. 3.

DETAILED DESCRIPTION OF THE PREFERRED EMBODIMENT

Figure 2:
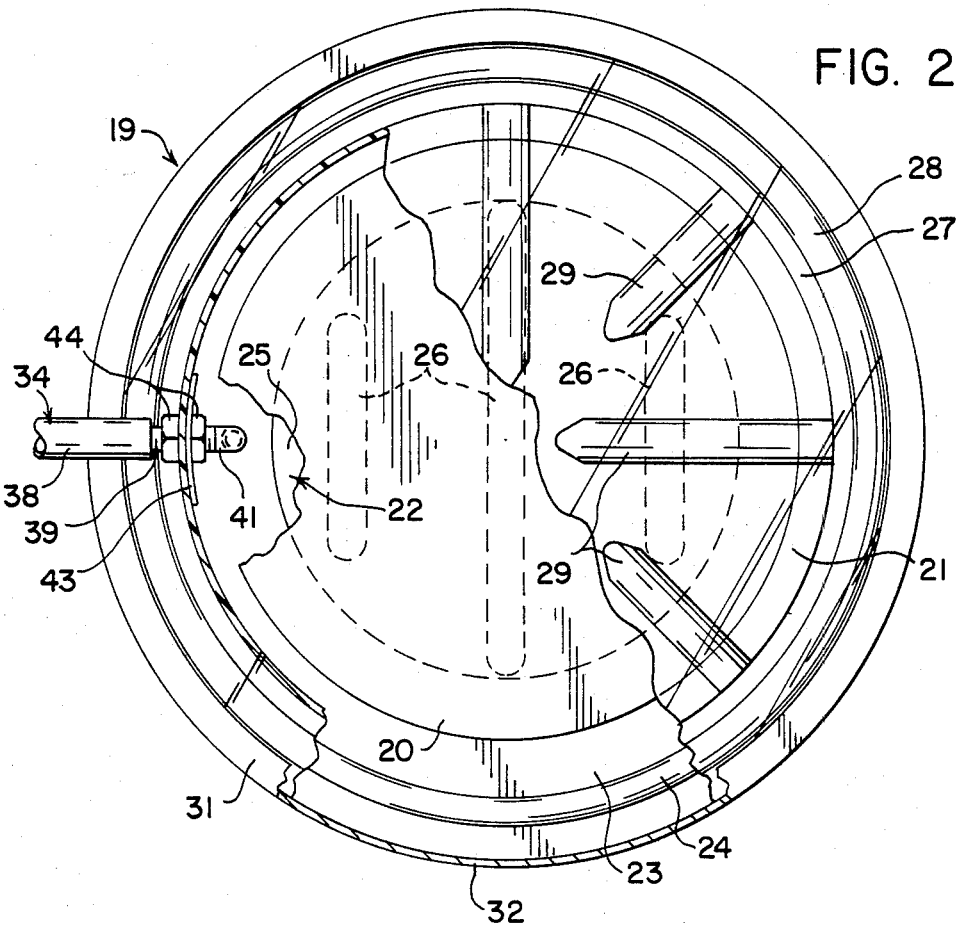
FIG. 2 is a top plan view, partly broken away and in section, of the solar actuated chamber of the drain system shown in FIG. 1.

As indicated above, the present invention relates to a temperature actuated drain system that is responsive to changes in temperature within a chamber to prime a siphon system. The drain system has particular application for draining water pooled on a flat roof.

Referring to FIG. 1, there is shown a temperature actuated drain system 10 installed on a flat roof 11 of the type on which a pool 12 of standing water occurs due to lack of proper drainage of the roof after a rain or as the result of melting ice or snow. A roof drain pipe 13 extends through the roof 11 at a position spaced from the pool 12 of standing water. The roof surface 14 at the pool 12 of standing water is lower than the roof surface adjacent the drain pipe 13 by an amount "h" causing the pool 12 of standing water to form on the roof.

In accordance with this invention, a siphon 15 has an inlet end 16 which may include a cup-shaped strainer 17. The siphon 15 also has a discharge or outlet end 18 positioned in the roof drain pipe 13. The inlet end 16 is at an upper level and the outlet end 18 is at a lower level below the inlet level 16. Desirably, the discharge end 18 of siphon 15 is about 5 feet or more below the level of inlet end 16 to provide an efficient siphoning action when siphon 15 is formed of tubing having about a 5/16 inch I.D.

A chamber 19 rests on the roof surface 14 adjacent the roof drain pipe 13. Chamber 19 has a fixed volume and includes a collector plate 20 confined within a fixed space formed by a transparent upper dome-shaped member 21 made of a hard, high-impact plastic material and a solar collector base 22 to which the collector plate 20 is bonded or otherwise secured. Solar collector base 22 has a generally flat horizontal peripheral zone 23 that contains a raised ridge 24 that extends around the entire peripheral zone 23 of collector base 22. The central portion of collector base 22 is formed into a cylindrical-shaped raised portion that forms a platform 25 for supporting collector plate 20 and that includes reinforcing ribs 26,26 to which collector plate 20 is secured along their zones of contact using a suitable bonding material. Dome 21 also has a generally flat horizontal peripheral zone 27 that contains a raised ridge 28 that extends around the entire peripheral zone 27 of dome 21. The peripheral zone 23 of solar collector base 22 and the peripheral zone 27 of dome 21 mesh and are bonded together using a suitable bonding material to form a hermetical seal between the peripheral zones of dome 21 and solar collector base 22. Collector plate 20 may be made of any suitable material that is capable of absorbing solar heat energy during the period that sun rays are impinging on the collector plate 20 and of radiating the heat energy which it has absorbed into the air confined within chamber 19. An aluminum plate coated on its upper face with a black coating to form a "black body" element has performed very satisfactorily in use. Dome 21, desirably, contains spaced ribs 29,29 that extend from the bottom portion of the dome 21 upwardly toward the dome's crown which impart additional rigidity to dome 21. A base plate 30, desirably formed of a non-corroding material (such as aluminum sheet), forms the base member of chamber 19. The peripheral edge 31 of base plate 30 is turned up and over the peripheral edges of dome 21 and solar collector base 22 to form a channel 32 into which said peripheral edges of dome 21 and solar collector base 22 snugly fit. Desirably, a suitable sealant is included within channel 32 to produce a second hermetical seal along the peripheral edges of dome 21 and solar collector base 22. The space between the raised central portion of collector base 22 and base plate 30 desirably is filled with concrete or some other ballast material to provide additional weight to chamber 19 for resisting wind dislodgement of chamber 19 from roof surface 14. Base plate 30 usually is bonded to roof surface 14 to further resist wind dislodgement of chamber 19.

Figure 3:
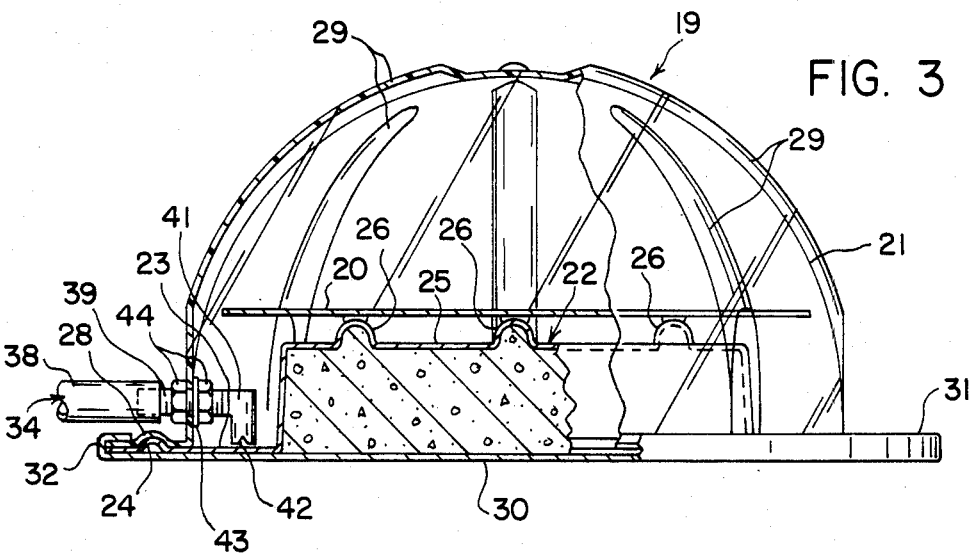
FIG. 3 is an elevation view, partly broken away and in section, of the solar actuated chamber shown in FIG. 2.

Siphon 15 is comprised of a first tubular member 33 and a second tubular member 34. One end of tubular member 33 forms inlet end 16 of siphon 15 while the distal end 35 of tubular member 33 forms a communicating Y-joint with tubular member 34 near the discharge end 18 of siphon 15. One end of tubular member 34 forms the discharge end 18 of siphon 15 and is in communication with a pressure-responsive one-way valve, such as flutter valve 37, that normally is closed and opens only when the pressure within siphon 15 exceeds the ambient pressure within drain pipe 13 and overcomes the force that normally maintains flutter valve 37 closed or when the siphon 15 is filled with sufficient water to overcome the force that normally maintains flutter valve 37 closed. The other end 38 of tubular member 34 is in open communication with and is attached to conduit 39 which extends through opening 40 in dome 21 and has an inlet end 41 positioned closely adjacent the bottommost reach of the interior of chamber 19. As shown in FIG. 3, conduit 39 may be bent downwardly after it enters the interior of chamber 19 until it essentially touches the bottommost reach of the interior of chamber 19. One or more notches 42 at the edge of the inlet end 41 of conduit 39 may be provided to permit air or water to be more readily drawn into conduit 39 during the operation of the drain system. The space between the outer surface of conduit 39 and opening 40 in dome 21 is hermetically sealed, for example with a seal 43 formed using a suitable sealant material that is adhered to dome 21 and to the outer surface of conduit 39. Nuts 44,44 retain the seal 43 tightly against the face of dome 21 and secures conduit 39 rigidly in place. Although the preferred embodiment shows tubular member 34 attached to a separate conduit component 39, it will be understood that the end portion of tubular member 34 need not be connected to a separate conduit component 39, but instead can itself extend through opening 40 and rest on or adjacent the bottommost area of the interior of chamber 19.

As indicated above, temperature actuated drain system 10 preferably is firmly affixed to the surface of the roof on which it is installed by adhering the bottom face of base plate 30 to the roof surface using a suitable bonding material. In addition, gravel or other ballast material can be spread over the flat peripheral zone 27 of dome 21.

In the operation of the drain system 10, when a pool of water has formed on the roof surface and covers the inlet end 16 of siphon 15 and the sun shines on dome 21 of chamber 19, heat energy is absorbed by collector plate 20. Heat energy, in turn, is radiated from collector plate 20 into the air space within chamber 19 heating the air contained in chamber 19 and causing the air to expand. As the air expands within chamber 19, the pressure within chamber 19 increases until it is sufficient to cause the one-way valve 37 to open. Air is expelled through valve 37 until the pressure within chamber 19 has dropped sufficiently to cause valve 37 to close. When the sun goes behind a cloud or sets, heat energy derived from the sun no longer is available for absorption by collector plate 20 and, thus, is not radiated into the interior of chamber 19. The air within chamber 19 cools and contracts due to its reduced temperature causing the pressure within chamber 19 to become subatmospheric (as compared to the ambient pressure outside of chamber 19). Air is drawn from siphon 15 into chamber 19 in an effort to equalize the pressure within chamber 19 with the ambient pressure outside of chamber 19. In so doing water is drawn into siphon 15 from the pool of water in which the opening of inlet end 16 of siphon 15 is immersed. The primary action of siphon 15 is repeated when the sun again shines on dome 21 and then goes behind a cloud or sets until a sufficient "head of water" is drawn into the vertical span of tubular member 33 to overcome the force that maintains valve 37 normally closed. The valve 37 then opens allowing water to be discharged from siphon 15. The siphoning action continues until the pool of water standing on the roof is drained sufficiently so that the opening of the inlet end 16 of siphon 15 no longer is immersed in water.

As indicated above, the suction force created in tubular member 34 of siphon 15 when the previously heated air confined within chamber 19 is cooled at times is sufficient to cause small amounts of water to be drawn from siphon 15 into chamber 19. The water which accumulates at the bottom of chamber 19, if not removed, interfers with the efficient operation of the drain system, as explained above. It will be appreciated that drain system 10 automatically provides for removal of water pooling within chamber 19, since, as soon as water accumulates within chamber 19 to a level to close the intake opening of inlet end 41 of conduit 39, the next occurrence of heating and expanding the air within chamber 19 forces the water that has accumulated in chamber 19 to be exhausted through conduit 39 and into siphon 15 until the intake opening of inlet end 41 of conduit 39 once again is in open communication with the air within chamber 19.

It will be understood that many and varied modifications of this invention will become apparent to those of ordinary skill in the art without departing from the scope of the present invention as defined in the appended claims.

We claim:

1. A temperature actuated drain system for transferring a water accumulation from a roof surface to a lower level at which the water is discharged from the drain system, said drain system comprising:

(a) a siphon comprised of a first tubular member and a second tubular member, and (b) an enclosed chamber with a bottom level comprised of a rigid upper component comprised of a wall that allows solar heat energy to pass therethrough into the interior of said chamber, a base member to which said upper component is hermetically sealed along its peripheral zone, and means confined within the confines of said chamber for absorbing solar heat energy during the period when the sun shines onto said chamber and radiating the collected heat energy into the confined air space within said chamber when the sun is not shining on said chamber, said first tubular member of said siphon having an inlet end for immersing in an accumulation of water to be drained from a roof surface and a distal end, said second tubular member of said siphon having a discharge end communicating with a pressure-responsive one-way valve means that opens when the pressure within said siphon or the force of a column of water within said siphon and acting against said valve exceeds the force that maintains said valve normally closed and closes when the pressure within said siphon or the force of a column of water within said siphon and acting against said valve is less than the force that maintains said valve normally closed, said second tubular member of said siphon being in open communication with the interior space of said chamber at a location immediately adjacent the bottom level of the interior space of said chamber, said distal end of said first tubular member of said siphon being joined in communicating relationship with said second tubular member of said siphon, said discharge end of said second tubular member of said siphon being positioned at a level below the level of the inlet end of said first tubular member of said siphon during the operation of said drain system.

2. The drain system of claim 1 wherein said juncture of the distal end of said first tubular member of said siphon with said second tubular member of said siphon being at a location closely adjacent the said discharge end of said second tubular member.

3. The drain system of claim 1 wherein said means for absorbing solar heat energy is a collector plate provided with a black surface directed toward said upper wall component of said chamber.

4. The drain system of claim 1 wherein the end of said second tubular member remote from the discharge end of said second tubular member is attached to and communicates with a conduit member having an inlet end that extends through an opening in the wall of the upper component of said chamber, the inlet end of the said conduit depending downwardly and terminating immediately adjacent the bottom level of the interior space of said chamber, and wherein said conduit is joined with the wall of said upper component of said chamber with a hermetical seal.

5. The drain system of claim 4 wherein the said inlet end contains at least one notch therein to facilitate the flow of fluid from the interior of said chamber into said conduit.

6. The drain system of claim 1 wherein said valve means is a flutter valve.

7. The drain system of claim 1 wherein said drain system is associated with a roof drain and said distal end of said first tubular member of said siphon and said discharge end of said second tubular member of said siphon are at a level in said roof drain that is below the level of the inlet end of said first tubular member immersed in said water accumulation.

8. The drain system of claim 1 wherein said upper component of said chamber is a rigid transparent dome-shaped member.

9. The drain system of claim 1 wherein said chamber includes a collector base member having a raised central portion which supports said solar heat energy collector means and having a peripheral zone joined to the peripheral zone of said upper component of said chamber with a hermetical seal.

10. The drain system of claim 9 wherein the peripheral zone of said base member of said chamber is turned up and over the peripheral edges of said upper component of said chamber and said collector base member forming a channel into which said peripheral edges of said upper component of said chamber and said collector base member fit and are sealed with a hermetical seal.

* * * * *